US006094934A

United States Patent [19]

Rand et al.

[11] Patent Number: 6,094,934

[45] Date of Patent: Aug. 1, 2000

[54] FREEZER

[75] Inventors: Thomas W. Rand; William E. Zellner, both of Conway; Robert J. Mercer, Greenbrier; Robert T. Topper, Heber Springs; Joseph F. Sanders, Conway, all of Ak.

[73] Assignee: Carrier Corporation, Farmington, Conn.

[21] Appl. No.: 09/167,346

[22] Filed: Oct. 7, 1998

[51] Int. Cl.[7] ..... F25D 11/00

[52] U.S. Cl. ..... 62/440; 62/448; 62/450; 62/515; 62/298; 312/116; 312/128

[58] Field of Search ..... 62/448, 450, 440, 62/515, 298; 312/116, 128

[56] References Cited

U.S. PATENT DOCUMENTS

| | | | |
|---|---|---|---|
| Re. 23,636 | 3/1953 | Mark et al. . | |
| D. 342,744 | 12/1993 | Renner | D15/81 |
| D. 352,620 | 11/1994 | Geisen et al. | D6/470 |
| D. 367,864 | 3/1996 | Lacewell | D15/85 |
| D. 368,394 | 4/1996 | Rogers | D6/470 |
| D. 377,800 | 2/1997 | Branz et al. | D15/85 |
| 1,524,520 | 1/1925 | Junkers . | |
| 1,789,913 | 1/1931 | Swezey . | |
| 1,825,694 | 10/1931 | Hobart . | |
| 1,825,870 | 10/1931 | King . | |
| 1,841,617 | 1/1932 | Lipman . | |
| 1,895,549 | 1/1933 | Lipman . | |
| 2,030,554 | 2/1936 | Van Sciver . | |
| 2,268,361 | 12/1941 | Walker et al. . | |
| 2,462,115 | 2/1949 | Luecke | 62/116 |
| 2,471,634 | 5/1949 | Mark et al. . | |
| 2,471,635 | 5/1949 | Mark et al. . | |
| 2,613,065 | 10/1952 | Didier . | |
| 2,620,254 | 12/1952 | Beckett . | |
| 2,645,359 | 7/1953 | Jewell . | |
| 2,914,927 | 12/1959 | Corhanidis . | |
| 2,970,702 | 2/1961 | Maslow . | |
| 3,111,728 | 11/1963 | Alderfer . | |
| 3,267,692 | 8/1966 | Pfeiffer et al. . | |
| 3,279,618 | 10/1966 | Bergstedt . | |
| 3,407,940 | 10/1968 | Packard . | |
| 3,436,137 | 4/1969 | Ranger . | |
| 3,712,078 | 1/1973 | Maynard et al. | 62/448 |
| 3,729,243 | 4/1973 | Musgrave et al. | 312/116 |
| 3,877,517 | 4/1975 | Pasternak | 165/146 |
| 4,056,211 | 11/1977 | Zumwalt | 220/9 G |
| 4,103,737 | 8/1978 | Perkins | 165/80 |
| 4,114,065 | 9/1978 | Horvay | 312/214 |
| 4,117,697 | 10/1978 | Myers et al. | 62/256 |
| 4,162,571 | 7/1979 | Horvay | 29/460 |
| 4,231,301 | 11/1980 | Barrineau, III | 108/146 |
| 4,285,210 | 8/1981 | McCarty | 62/325 |
| 4,295,261 | 10/1981 | Scherer | 29/451 |
| 4,348,965 | 9/1982 | Swanson | 108/152 |
| 4,349,171 | 9/1982 | Baldwin | 248/243 |
| 4,454,948 | 6/1984 | Spamer | 211/49 D |
| 4,644,698 | 2/1987 | Gerdes et al. | 49/478 |
| 4,822,117 | 4/1989 | Boston, Jr. | 312/214 |
| 4,829,652 | 5/1989 | Haas et al. | 29/451 |

(List continued on next page.)

*Primary Examiner*—William Doerrler
*Assistant Examiner*—Mark Shulman
*Attorney, Agent, or Firm*—Pearne & Gordon LLP

[57] ABSTRACT

A refrigeration machine for merchandising and displaying frozen articles. The refrigeration machine has a cabinet having a front wall, opposing side walls and an intermediate support shelf. A top portion of the front wall and the side walls extend above the intermediate support shelf to define a refrigeration unit compartment. The top portion of the front wall has a thicken area and a forward portion of the side walls also have thickened areas that are continuous with the thickened area of the front wall. The thickened areas form a boss which engages a divider wall of a refrigeration unit. The refrigeration unit is removable from the cabinet as a single member. The refrigeration unit has mounts for a compressor and a condenser so that an electrical tray and a condensate tray can be placed under the compressor and condenser. The cabinet has shelf supports that support shelves at varying degrees of inclination. For this, the shelf support have support surfaces and abutment surfaces and the shelves have supported surfaces and stop surfaces.

23 Claims, 7 Drawing Sheets

U.S. PATENT DOCUMENTS

| | | | |
|---|---|---|---|
| 4,907,419 | 3/1990 | Kruck et al. | 62/263 |
| 4,949,554 | 8/1990 | Branz et al. | 62/248 |
| 4,953,362 | 9/1990 | Shoji et al. | 62/246 |
| 4,977,754 | 12/1990 | Upton et al. | 62/248 |
| 5,060,358 | 10/1991 | Haas et al. | 29/235 |
| 5,086,831 | 2/1992 | Paikert et al. | 165/47 |
| 5,123,545 | 6/1992 | Hickman | 211/59.2 |
| 5,129,184 | 7/1992 | Fish | 49/478 |
| 5,199,273 | 4/1993 | Silva et al. | 62/298 |
| 5,203,255 | 4/1993 | Wells et al. | 99/468 |
| 5,277,486 | 1/1994 | Bustos | 312/125 |
| 5,402,654 | 4/1995 | Rudick et al. | 62/448 |
| 5,417,079 | 5/1995 | Rudick et al. | 62/253 |
| 5,417,081 | 5/1995 | Rudick et al. | 62/440 |
| 5,450,971 | 9/1995 | Boron et al. | 211/134 |
| 5,464,279 | 11/1995 | Wells et al. | 312/128 |
| 5,491,980 | 2/1996 | Yingst et al. | 62/237 |
| 5,533,311 | 7/1996 | Tirrell et al. | 52/309.9 |
| 5,549,373 | 8/1996 | Bustos | 312/135 |
| 5,567,026 | 10/1996 | Lacewell | 312/135 |
| 5,600,966 | 2/1997 | Valence et al. | 62/440 |
| 5,622,057 | 4/1997 | Bussjager et al. | 62/173 |
| 5,678,421 | 10/1997 | Maynard et al. | 62/407 |

FREEZER

BACKGROUND OF THE INVENTION

The present invention generally relates to refrigeration devices. More specifically, the present invention relates to commercial freezers for counter-top merchandising.

There exists a need in the art of refrigeration devices for an economical counter-top display-type freezer for merchandising frozen products such as ice cream. Such a freezer should be compact, provide high product visibility and have an attractive marketing appeal. Freezer currently available for these purposes have reliability problems due to their heavy usage. They are also difficult and expensive to maintain since refrigeration unit components are typically fully integrated with the freezer cabinet. Therefore, there is a need in the art for a display and merchandising freezer that is capable of maintaining its performance and reliability through periods of heavy usage.

BRIEF SUMMARY OF THE INVENTION

The present invention provides a refrigeration machine having a cabinet. The cabinet has a front wall, opposing side walls and an intermediate support shelf. A top portion of the front wall and the side walls extend above the intermediate support shelf to define a refrigeration unit compartment. The top portion of the front wall has a thickened area and a forward portion of the side walls also have a thickened area contiguous with the thickened area of the front wall. The thickened areas form a boss. A refrigeration unit is disposed in the refrigeration unit compartment and has an insulated divider wall. The divider wall engages the boss.

According to another aspect of the invention, a refrigeration unit is provided. The refrigeration unit has an insulated divider wall, the divider wall having a first side and a second side. An evaporator is mounted to the first side of the divider wall. A base is secured to the second side of the divider wall. A compressor mount and a condenser mount are secured to the base. The compressor mount supports and elevates a compressor to define a passageway under the compressor. The condenser mount supports and elevates a condenser to define a passageway under the condenser. An electrical tray for holding electrical components is slidably disposed in one of the passageways and a condensate collection tray is slidably disposed in the other of the passageways.

According to another aspect of the invention, a cabinet is provided with opposing side walls. The side walls having a plurality of shelf supports. Each support has a support surface and an abutment surface. A shelf is also provided. The shelf has supported surfaces and stop surfaces for respectively engaging the support surface and abutment surface. The shelf may be positioned on the shelf supports at varying degrees of inclination.

BRIEF DESCRIPTION OF THE SEVERAL VIEWS OF THE DRAWING

These and further features of the present invention will be apparent with reference to the following description and drawings, wherein.

DETAILED DESCRIPTION OF THE PREFERRED EMBODIMENTS OF THE INVENTION

Figure 1:
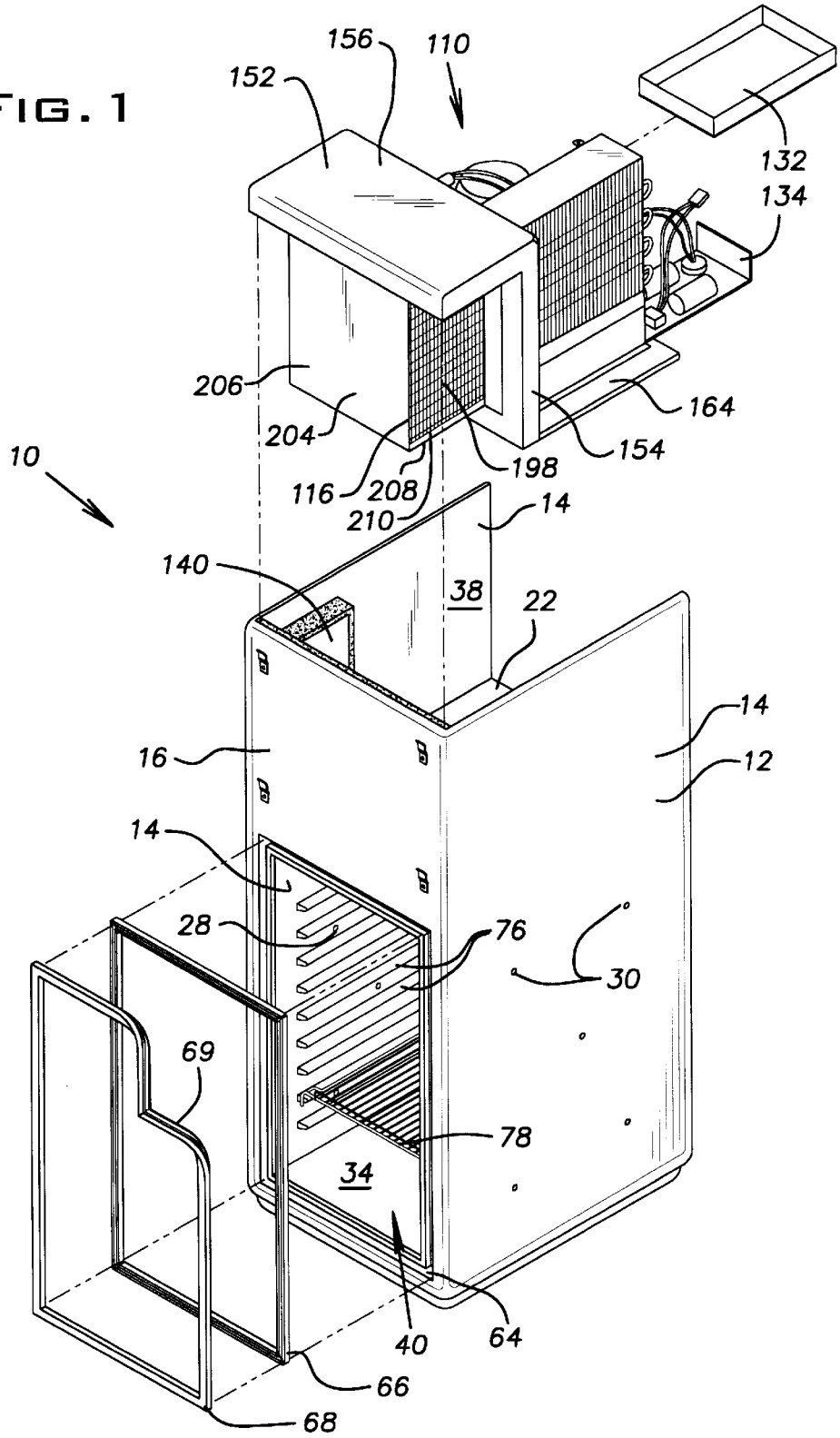
FIG. 1 is an exploded front perspective view of a freezer according to the present invention.

In the detailed description which follows, identical components have been given the same reference numerals, and, in order to clearly and concisely illustrate the present invention, certain features may be shown in somewhat schematic form.

Referring to FIGS. 1 through 4, a refrigeration device, or freezer 10, is shown. The illustrated freezer 10 is a counter-top display-type freezer for merchandising frozen products, such as ice cream, but other types of freezers and refrigerators are within the scope of the present invention. The invention may also relate to a heated display or merchandising case. The freezer 10 provides a cabinet 12 having vertical side walls 14, a front end wall 16 and a rear end wall 18. The cabinet 12 is also provided with a bottom wall 20 and an intermediate support shelf 22. The cabinet 12 is preferably made from a unitary piece of rotationally molded plastic. Each of the walls 14, 16, 18, 20, 22 of the cabinet 12 has a hollow interior into which expandable foam insulation is injected. In order to maintain a relatively uniform thickness of the walls, srews 28 and screw anchors 30 can be inserted in the cabinet walls at strategic locations. Alternatively, the walls 14, 16, 18, 20, 22 may be made from solid plastic.

The cabinet provides a product display chamber 34. The display chamber 34 is generally parallelepipedic and is defined by the bottom wall 20, the side walls 14, the front wall 16, the rear wall 18 and the support shelf 22, as illustrated. An upper portion 36 of the side walls 14 and the front wall 16 extends vertically above display chamber 34 and the intermediate support shelf 22, thereby defining a refrigeration unit compartment 38. The rear wall 18 preferably extends only as high as the intermediate support shelf 22. An internal lamp for providing illumination in the display chamber 34 can be attached to the underside of the intermediate support shelf 22.

The front wall 16 and the rear wall 18 each define an aperture 40 in the region where these walls 16, 18 define the display chamber 34. At least one of the apertures 40 is provided with a door 42. Should an aperture not be provided with a door 42, it will be provided with a window 44. The door(s) 42 and window 44 provide visibility into the display chamber 34. The door(s) 42 also provide access into the display compartment 34. Accordingly, the door 42 is provided with a handle 46 and is pivotally mounted to the cabinet 12 with hinges 48, as is known in the art. The hinges 48 preferably bias the door 42 toward the closed position.

The door 42 is preferably provided with a metal outer frame 52 used to support double panes of glass 54. The door 42 is also provided with a plastic inner frame 56 which spaces the outer frame 52 and glass 54 away from the cabinet 12 when the door 42 is in the closed position. The inner frame 56 is provided with a groove for receiving a retaining a first rubber gasket 58 having a magnetic sealing member disposed therein. In order to prevent the build-up of condensation and ice on the door 42, the outer pane of glass 54 is provided with a transparent thin film defroster 60 and associated bus bars 62, as is known in the art. The perimeter of the outer frame 52 and the inner frame 56 under the gasket 58 are also provided with defrost heaters.

Since the cabinet 12 is preferably made of plastic, it is necessary to provide a gripping member for the magnetic sealing member of the gasket 58 to adhere to when the door 42 is in the closed position. Accordingly, the cabinet 12 is provided with a channel 64 disposed around the periphery of the apertures 40 in the front wall and the rear wall 18. A plastic gasket holder 66 is press fit and also preferably screwed into the channel 64. The gasket holder 66 receives and retains a second rubber gasket 68 having a magnetic sealing member disposed therein. The gasket holder 66 is preferably provided with a hollow square shaped cross-section, or other geometric cross-section adapted to fit in the channel 64. On an outwardly facing side of the gasket holder 66, the gasket holder 66 has a slit type opening to receive the second gasket 68. The second gasket 68 is shown partially bent back in FIG. 1 to illustrate a retaining portion 69 of the gasket 68 that is received by the gasket holder 66. When the door 42 is in the closed position, the magnetic sealing members of the first and the second gaskets 58, 68 are attracted to one another to hold the door 42 closed and minimize heat and air loss out of the freezer 10 through the aperture 40. For additional sealing, silicone caulking can be placed in the channel 64 between the cabinet 12 and the gasket holder 66. One skilled in the art will appreciate that one of the magnetic sealing members of one of the gaskets 58, 68 need not be magnetic, but may be made of a material that the other magnetic sealing member will be attracted to.

As indicated, should a door 42 not be used to cover the aperture in either the front wall or the rear wall 18, a window 44 is used to cover the aperture 40. The window 44 has a window frame 70, preferably made of metal or plastic, used to hold double panes of glass 54. The outer pane 54 is preferably provided with a transparent thin film defroster 60 and associated bus bars 62. The window frame 70 is attached to the cabinet 12 by securing the window frame 70 in the channel 64 disposed around the aperture 40. A piece of foam or felt-like material may be provided between the window frame 70 and the cabinet 12 to help minimize heat and air loss out of the freezer 10 through the aperture 40.

Figure 8:
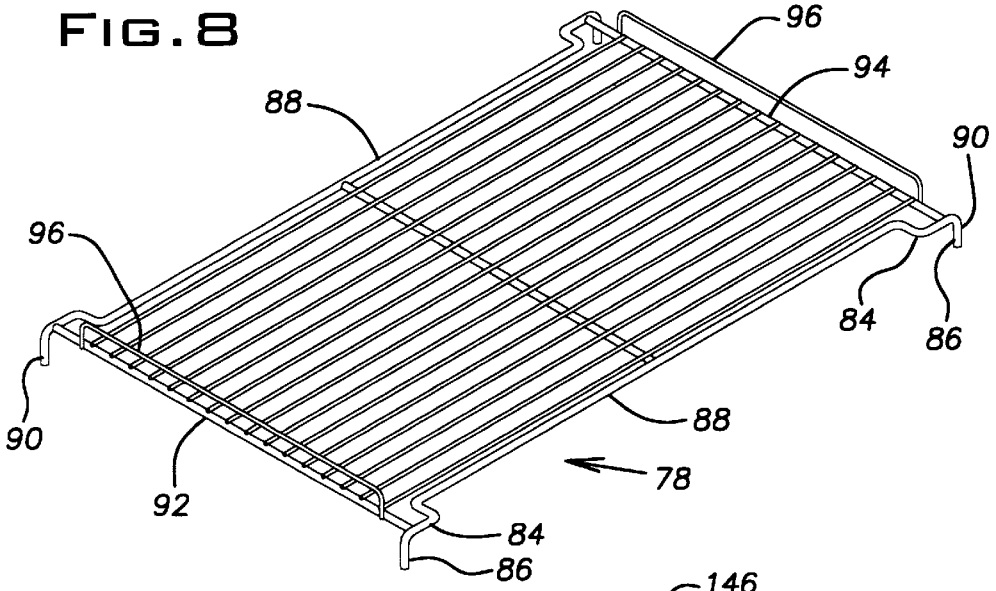
FIG. 8 is a perspective view of a shelf according to the present invention.
Figure 9:
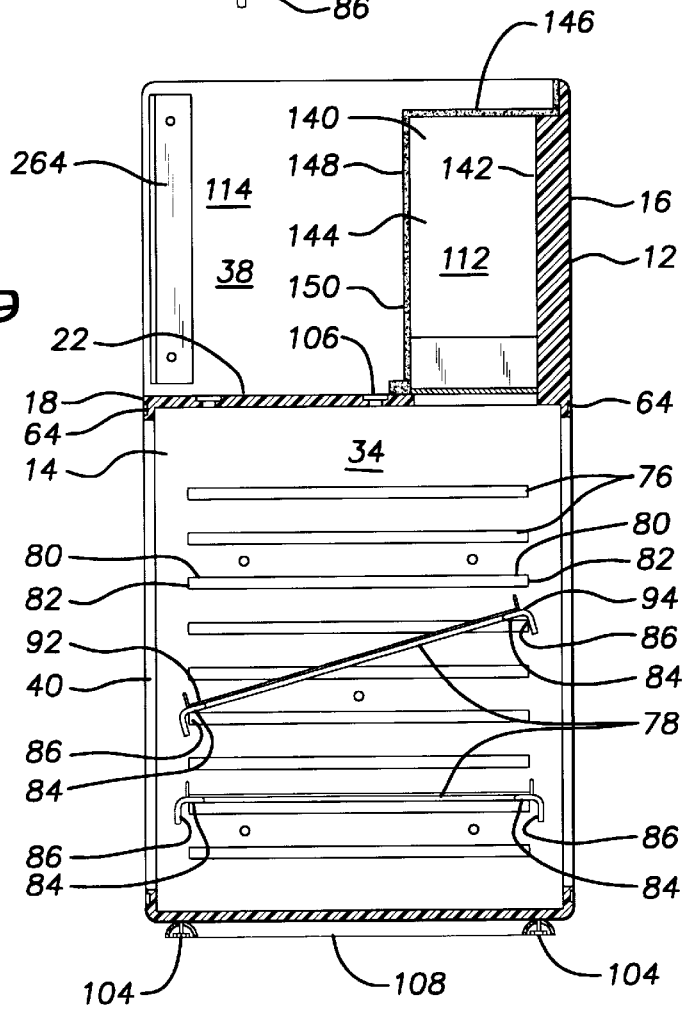
FIG. 9 is a cross-sectional view of the cabinet along the line 9—9 of FIG. 5.

With additional reference to FIGS. 8 and 9, the interior surfaces of the side walls 14 in the area defining the display chamber 34 are provided with supports 76. The supports 76 are used to support shelves 78 for the display of product in the display chamber 34. As will be more fully explained below, the supports 76 are horizontally spaced away from the front wall 16 and rear wall 18. The supports 76 are also vertically spaced apart and, on each of the side walls 14, sets of supports 76 are positioned at substantially the same vertical elevations. The supports 76 each provide a support surface 80 on top and an abutment 82 at an end. In the illustrated preferred embodiment, the supports 76 are elongated shoulders protruding from the interior side wall 14 surfaces. As one skilled in the art will appreciate, the supports 76 need not be elongated shoulders, so long as they provide the support surface 80 and the abutment 82 for respectively engaging supported surfaces 84 and stop surfaces 86 provided on the shelves 78 as described below. In other implementations, two supports 76, one adjacent the front wall 16 and one adjacent the rear wall 18, may be provided on each side wall 14 at each desired elevation. The supports 76 are preferably formed as part of the cabinet 12 during the molding process, but may also be attached after the cabinet 12 molded.

As stated, the shelves 78 provide a supported surface 84 and a stop surface 86. The supported surface 84 is preferably formed by a lateral projection which protrudes laterally from the overall plane of the shelf 78. The stop surface is preferably formed by a downward projection which protrudes vertically from the end, or adjacent the end, of the shelf 78. In the illustrated preferred embodiment, the shelf 78 is a painted or plastic coated wire rack. Edge wires 88 of the shelf 78 are flared outward adjacent the shelf ends so that the shelves are wider near the ends than along the length of the shelf 78, thereby providing the supported surface 84. The ends of the edge wires 88 are preferably bend downward to form a finger 90, thereby providing the stop surface 86. As one skilled in the art will appreciate, other types of shelves 78, such as glass or plastic panels mounted in a frame, will work with equivalent results. The frame can be manufactured to include the supported surfaces 84 and the stop surfaces 86.

Providing a shelf 78 with supported surfaces 84 and stop surfaces 86 permits each shelf to be positioned at various angles in the display chamber 34 and to be quickly and easily repositioned at a different angles. The shelf 78 may be positioned horizontally by placing all of the shelf's supported surfaces 84 on support surfaces 80 of equal elevation. The shelf 78 may be positioned at an angle by placing the supported surfaces 84 of a first end 92 of the shelf 78 on a pair of support surfaces 80 having the same elevation and the supported surfaces 84 of a second end 94 of the shelf 78 on a pair of support surfaces 80 having a lower or higher elevation. In the angled position, the stop surfaces 86 of the higher end 92 or 94 of the shelf 78 will engage the abutment surfaces 82 of the supports 76 adjacent the higher end to prevent the shelf 78 from sliding off of the supports 76. When the shelves 78 are angled, the unflared portions of the shelves 78 clear and cross the supports 76. It should be appreciated that the shelves 78 may be positioned at varying angles and sloped toward either the front end 16 or the rear end 18. The degree of inclination and the direction will depend on which end(s) of the cabinet 12 the door(s) 42 are on, how the merchant using the freezer 10 wants to display the product and who (i.e., customer, employee or both) the merchant wants to access the product. The shelves 78 are also provided with guards 96 to prevent product from sliding off the shelves 78 when they are angled.

In order to adjust the angle of a shelf 78, the shelf 78 is lifted to disengage the supported surfaces 84 from the support surfaces 80 and the stop surfaces 86 from the abutment surfaces 82. The shelf 78 is then pulled forward so that the lateral projections of the first end 92 can vertically pass the supports 76 in the space provided between the supports 76 and the front wall 16. The first end 92 is then vertically moved to the desired elevation and the shelf 78 is pushed backward and downward to reengage the supported surfaces 84 with the support surfaces 80 and the stop surfaces 86 with the abutment surfaces 82. One skilled in the art will appreciate that the forgoing procedure can be modified to adjust the elevation of the second end 94 of the shelf 78.

Figure 6:
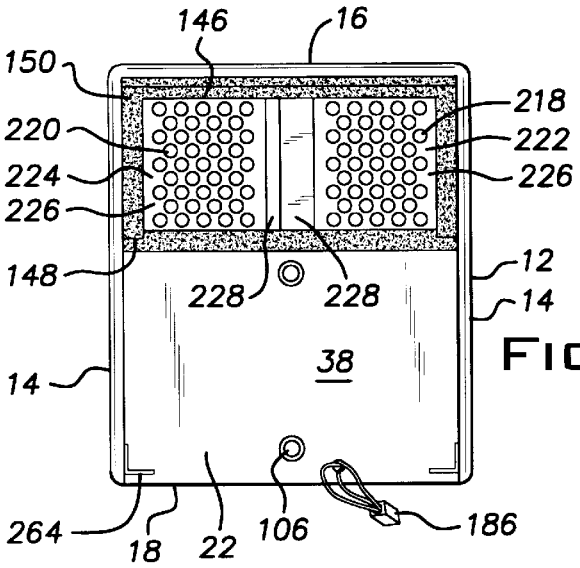
FIG. 6 is a top plan view of the cabinet according to the present invention.
Figure 7:
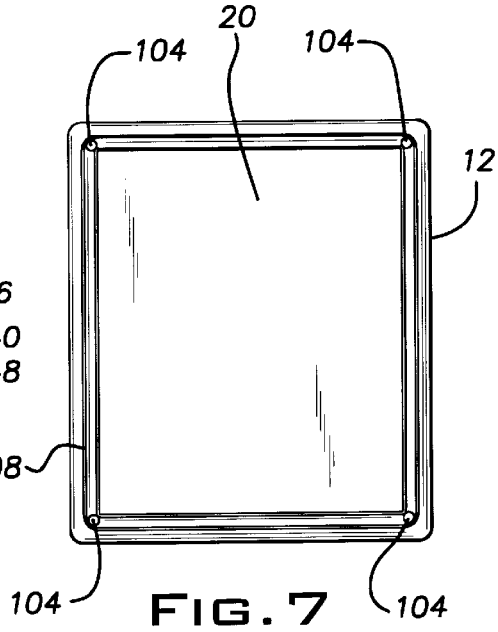
FIG. 7 is a bottom plan view of the cabinet according to the present invention.

Referring now to FIGS. 7 and 9, the bottom of the freezer 10 is provided with leveling legs 104, as are known in the art. The legs 104 preferably screw into nuts which are molded into the cabinet 12 during the cabinet 12 molding process. An example of the result of molding a nut 106 in situ with the mold in shown in FIG. 6. These nuts 106 are preferably flush with the surface that they are molded into. The legs 104 are adapted to hold a sealing member 108 to the exterior surface of the bottom wall 20. The sealing member 108 is preferably disposed adjacent the perimeter of the bottom of the cabinet 12 and acts as a physical barrier to substantially prevent debris, people's appendages, pests and the like from going under the freezer 10. The sealing member 108 is preferably a rubber gasket having an inverted "U" shape cross section with flared edges, similar to that of a suction cup or an inverted contact lens. The weight of the freezer 10 applies downward pressure on the sealing member 108 so that it forms a seal by engaging against the surface that the freezer 10 is supported by. The seal is akin the seal a suction cup forms against a surface, but having a smaller vacuum strength.

Referring to FIGS. 1, 2, 5, 6, and 9, the refrigeration unit compartment 38 is shown. The compartment 38 is defined on three sides by the upper portion 36 of the side walls 14 and the front wall 16. The compartment 38 is adapted to house a refrigeration unit 110. The refrigeration unit 110 is preferably removable from the cabinet 12 together with all its electrical and condensate lines for easy replacement of maintenance. The compartment 38 is further divided into a cold compartment, or first compartment 112, and a hot compartment, or second compartment 114. The first compartment 112 is adapted to house certain refrigeration unit 110 components including an evaporator 116, evaporator fan 118 and evaporator fan motor 120. The second compartment 114 is adapted to house other refrigeration unit 110 components including a condenser 122, a condenser fan 124, a condenser fan motor 126, a compressor 128, a compressor motor 130, condensate collection tray 132, and an electronics tray 134.

In order to minimize heat transfer between the first compartment 112 and any surrounding environment, the first compartment 112 is preferably well sealed and insulated. Accordingly, the first compartment 112 is preferably provided with thickened side walls 140 and a thickened front wall 142. The thickened walls 140, 142 which will hereinafter be referred to as a boss 144, provides additional insulating material around the first compartment 112. The boss 144 also provides a sill surface 146 and a buttress surface 148. A compressible insulator 150, such as closed-cell foam rubber, is preferably disposed on the sill surface 146 and the buttress surface 148. Additional compressible insulator material 150 is disposed on the front wall 16 above the sill surface 146 and on the intermediate support shelf 22 adjacent the boss 144 and extending laterally across the shelf 22.

The first compartment 112 is further defined by a leg, or top wall 152, and a divider wall 154. The divider wall 154 is disposed between the first compartment 112 and the second compartment 114. The top wall 152 and divider wall 154 are preferable integrally made from a single piece of material, hereinafter referred to as a partition 156. The partition 156 is preferably an up-side-down "L" shaped piece of molded plastic having spaced insulated walls similar to those of the cabinet 12. The partition 156 not only defines the top and rear of the first compartment 112, but is also part of the structure of the refrigeration unit 110.

Figure 2:
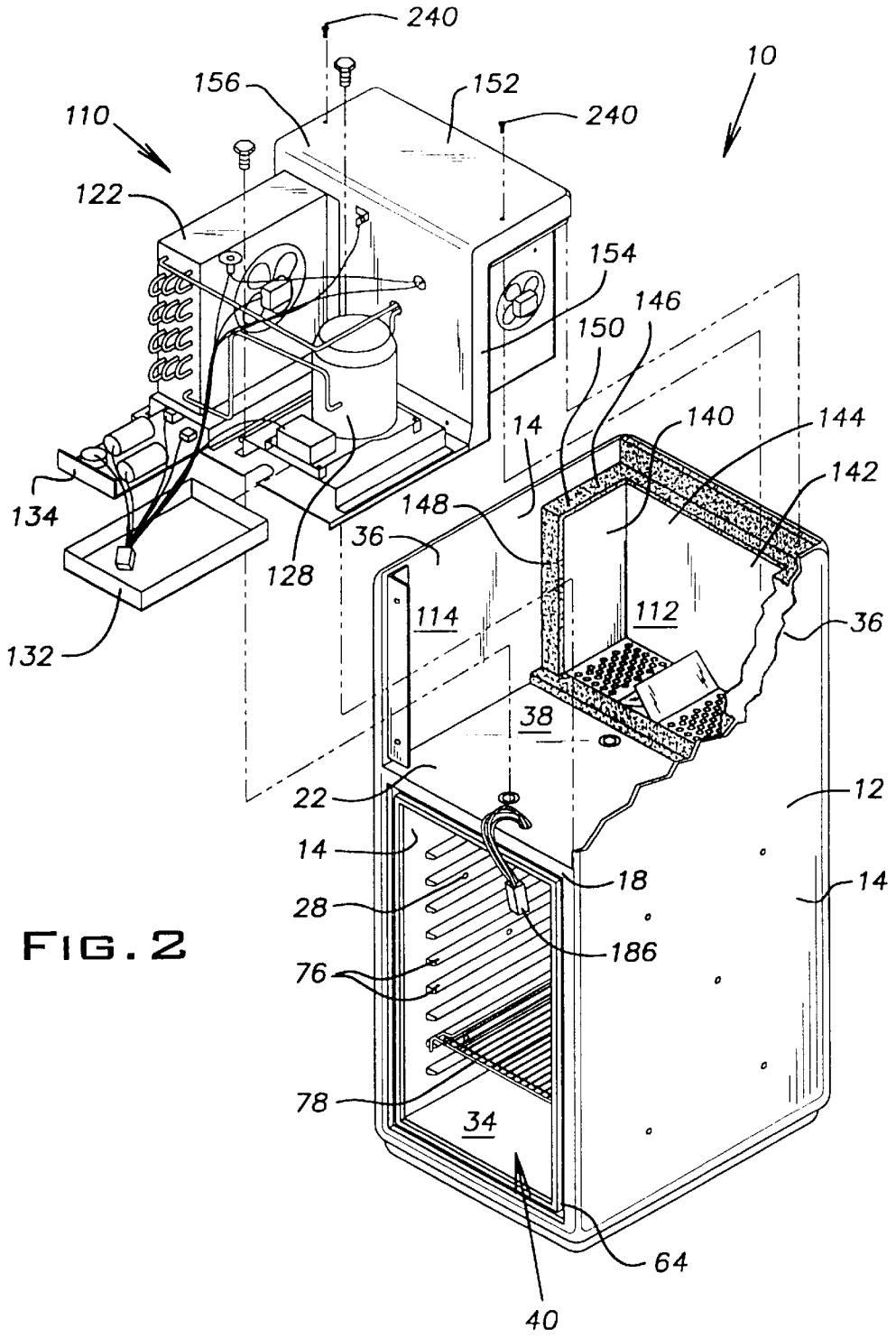
FIG. 2 is an exploded rear perspective view of the freezer according to the present invention, shown partially broken away.
Figure 3:
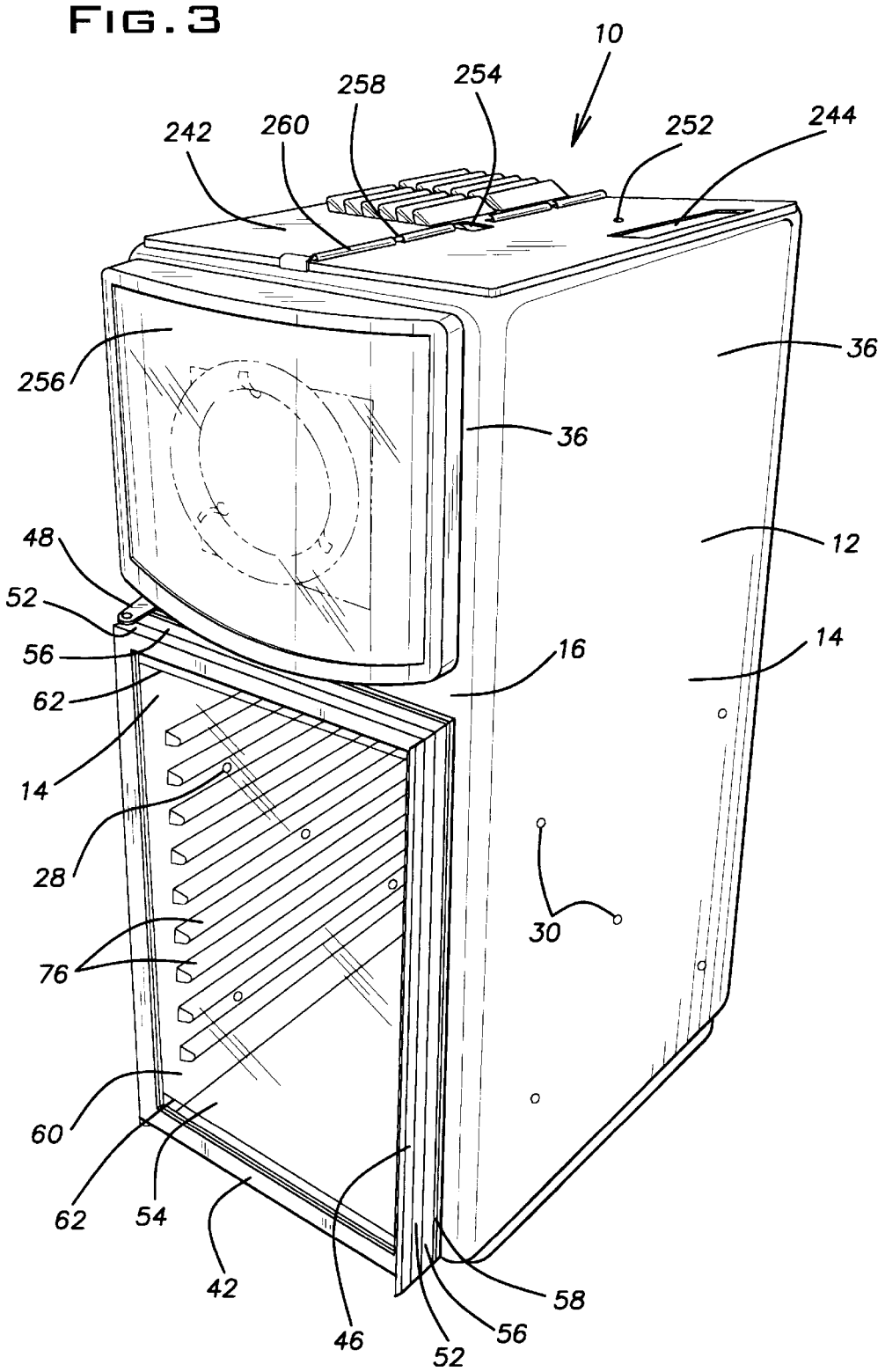
FIG. 3 is an assembled front perspective view of the freezer according to the present invention.
Figure 4:
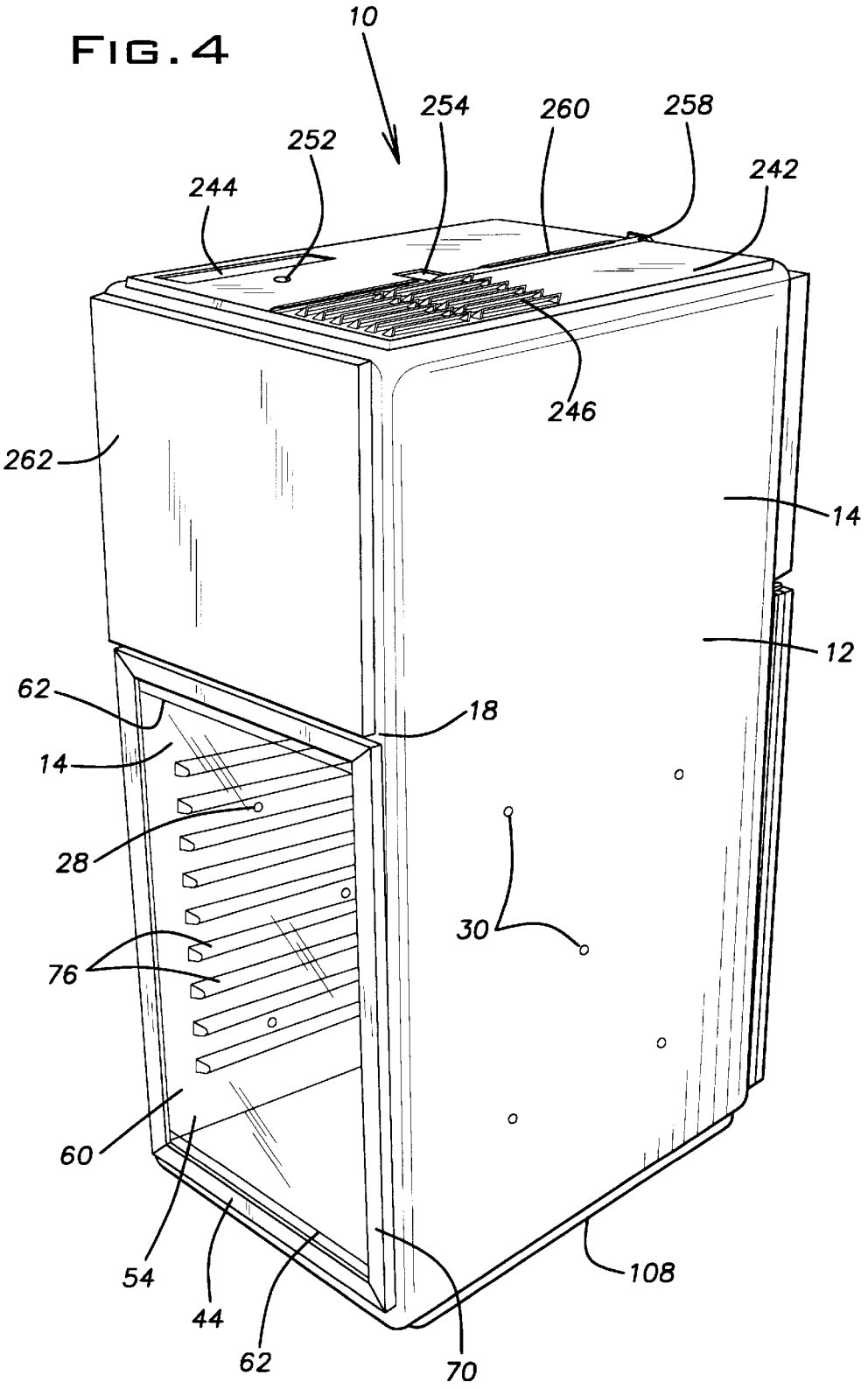
FIG. 4 is an assembled rear perspective view of the freezer according to the present invention.
Figure 10:
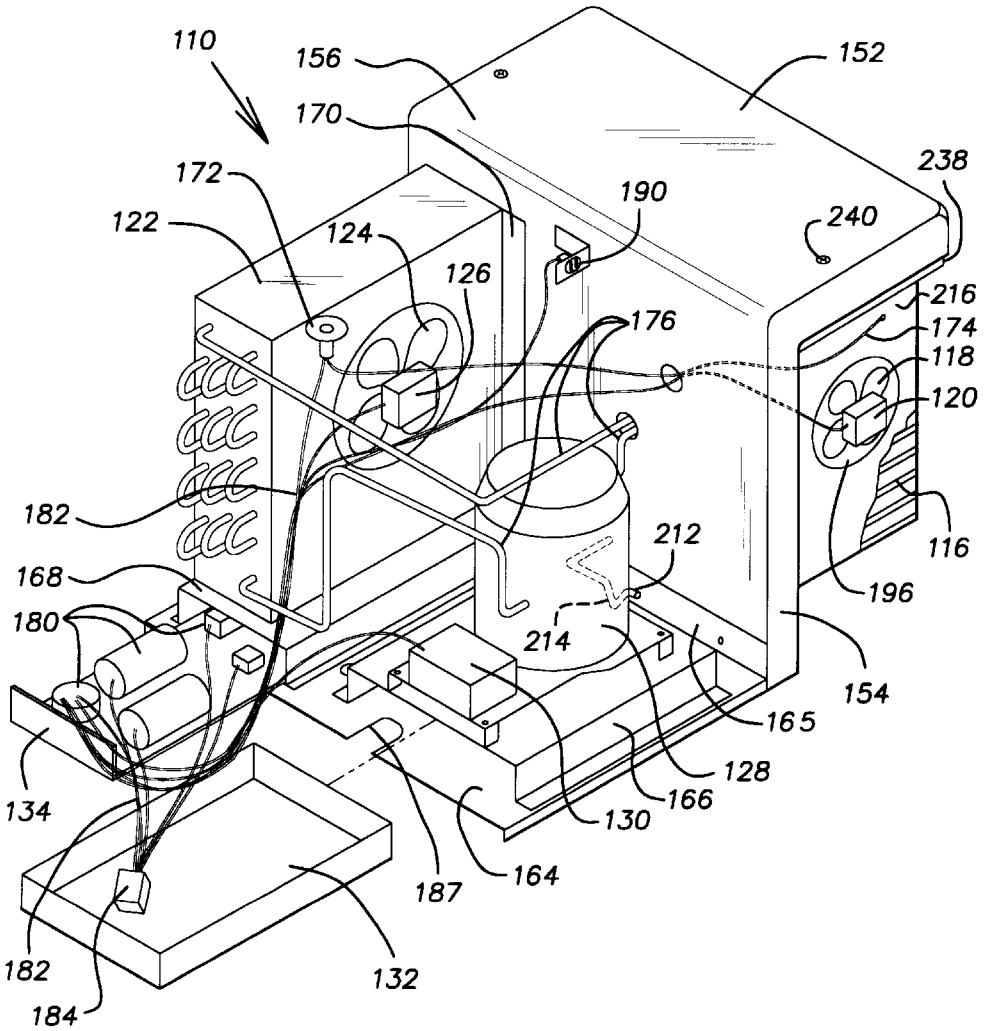
FIG. 10 is an enlarged perspective view of a refrigeration unit according to the present invention, shown partially broken away.

With reference to FIGS. 1, 2 and 10, the refrigeration unit 110 will now be described in detail. The refrigeration unit 110 provides a bas 164. The base 164 is preferably made of sheet metal and is attached to the second compartment side of the divider wall 154 portion of the partition 156. For this purpose, the base 164 may have a bracket portion 165, which is bent upward and secured to the partition 156 with screws 108. The base 164 supports a compressor mount 166 and a condenser mount 168. The compressor mount 166 elevates the compressor 128 and the compressor motor 130 from the base 164, thereby defining a passageway under the compressor 128. The condenser mount 168 elevates the condenser 122, condenser fan 124 and condenser fan motor 126 from the base 164, thereby defining a passageway under the condenser 122. Both of the mounts 166, 168 are preferably made of sheet metal and are screwed or bolted to the base 164. The condenser 122, which is a fin and tube type condenser, as is known in the art, is further secured to the partition 156 with an angle bracket 170. An adjustable thermostat 172 is mounted on the condenser 122 so that the thermostat 172 is in a convenient location for adjustment. The thermostat 172 may alternatively be secured to the partition 156 or other parts of the freezer 10 as is convenient. The thermostat 172 is provided with a temperature probe 174, as is known in the art, which extends through the partition 156 into the first compartment 112. Condensate lines 176 from the condenser 122 to the evaporator 116 and from the evaporator 116 to the compressor 128 also extend through the partition 156.

As mentioned, the refrigeration unit 110 provides the electrical tray 134, upon which various electrical components 180, such as light ballasts, a defrost timer, transformers, and a control circuit, are disposed. The electrical tray 134 is shaped and sized to slidably fit in the passageway under the condenser 122. The electrical tray 134 is preferably made from sheet metal. Wires 182 leading to the electrical components 180 on the electrical tray 134 and requiring connection to items that are not part of the refrigeration unit 110 are preferably terminated by a first wiring harness 184. The first wiring harness 184 is adapted to matably connect to a second wiring harness 186. The second wiring harness 186 is the terminal point for wires 182 disposed in the cabinet walls and leading to a power source, and the previously mentioned defrosters and internal lamp. A notch 187 is preferably provided in the base 164 for passage of the wires 182 into the refrigeration unit compartment 38.

The refrigeration unit 110 also provides the condensate collection tray 132 shaped and sized to slidably fit in the passageway under the compressor 128. The condensate collection tray 132 is preferably made from sheet metal, but other materials, such as plastic, will suffice. As will be more fully explained below, condensate is collected in the condensate collection tray 132 and evaporated, in part, by heat generated by the compressor 128.

A lamp outlet 190 is preferably provided by the refrigeration unit 110. The outlet 190 is secured to the partition 156 with a bracket and is positioned adjacent the top of the divider wall 154 portion of the partition 156.

As stated, the refrigeration unit provides an evaporator 116. The evaporator 116 is secured to the first compartment 112 side of the divider wall 154 portion of the partition 156 by angle brackets. The evaporator 116 is of the fin and tube type, as is known in the art, and has an air return side 196 and an air supply side 198. The fins of the evaporator 116, however, are staggered such that the leading row of tubes adjacent the return side 196 are bare (i.e., not covered by any fins). The remaining rows of tubes have fins with staggered leading edges. In other words, the fins are of different lengths as measured in the direction of the air flow. The leading edges of the fins accommodate moisture removal by accumulating frost at different elevations in the evaporator 116. This reduces the concentration of frost build-up with the goal of preventing the evaporator 116 from becoming clogged with ice. An example of such an evaporator is found in U.S. Pat. No. 3,267,692 incorporated herein by reference.

The first compartment 112 is provided with a cover plate 204, preferably made from sheet metal or plastic, that is secured to the partition 156. The cover plate has a vertical portion 206 disposed between the front wall 16 and the evaporator 116. The cover plate 204 also has a horizontal portion 208 disposed under the evaporator 116. The horizontal portion 208 of the cover plate 204 collects condensate from the evaporator 116, and is preferably provided with raised edges 210 to prevent condensate from freely flowing off the cover plate 204. The condensate is channeled to a pipe 212 that extends through the partition 156. The pipe 212 may either be secured to the cover plate 204 or integrally formed with the cover plate 204. The pipe 212 carries condensate from the cover plate 204, through the partition 156 to the condensate collection tray 132 disposed under the compressor 128. The pipe 212 is preferably provided with a "U" shaped trap 214.

The evaporator fan 118 and the evaporator fan motor 120 are preferably disposed on the return side 196 of the evaporator 116. Wires 182 for powering the evaporator fan motor 120 pass through the partition 156. A deflector plate 216 is also disposed on the return side 196 of the evaporator 116 to help guide air through the evaporator 116. The deflector plate 216 is preferably made from sheet metal and has an aperture disposed adjacent the evaporator fan 118 to allow the evaporator fan 118 to direct air through the evaporator 116. The supply side 198 of the evaporator 116 is preferably left exposed.

Figure 5:
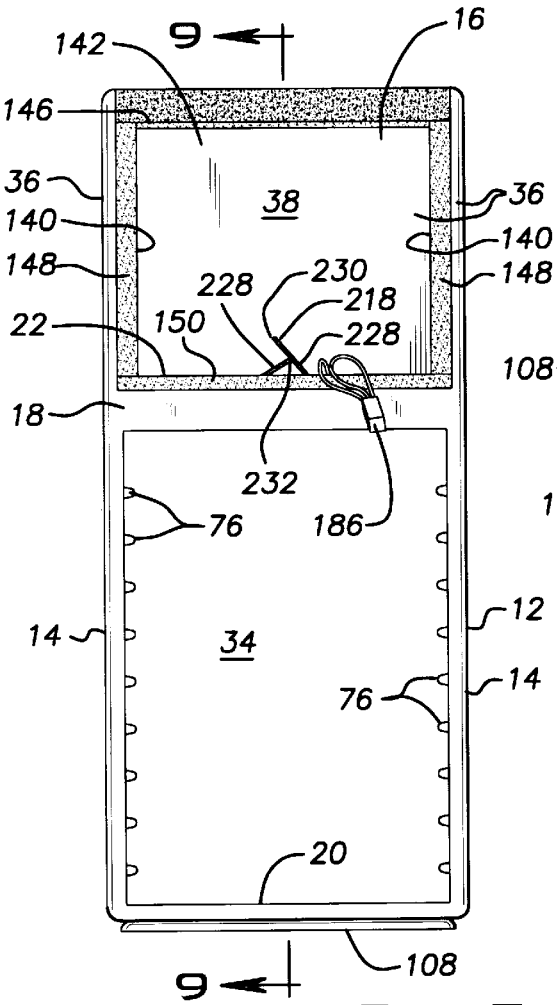
FIG. 5 is a rear plan view of a cabinet according to the present inventor.

With additional reference to FIGS. 5 and 6, the first compartment 112 provides a first airflow pathway for air from the display chamber 34 to be cooled. The air is drawn by the evaporator fan 118 into the first compartment 112 from the display chamber 34 through a return opening 218 in the intermediate support shelf 22. The air enters the return side 196 of the evaporator 116, travels through the evaporator 116 and exits the supply side 198 of the evaporator 116. The air the travels back into the display chamber 34 through a supply opening 220 in the intermediate support shelf 22.

The freezer 10 further provides a return side separator plate 222 and a supply side separator plate 224, each made from sheet material such as painted sheet metal. Each separator plate 222, 224 has a perforated section 226 and a solid section 228. The perforated section 226 of the return and supply separator plates 222, 224, respectively cover the return and supply openings 218, 220 in the intermediate support shelf 22. The perforations are adapted to allow air to flow through the plates, 222, 224, but to prevent objects from extending too far into the first compartment 112 from the display chamber 34. The solid sections 228 of the separator plates 222, 224 are adapted to laterally separate the first compartment 112 by cooperating with each other and with the horizontal portion 208 of the cover plate 204. Lateral separation of the first compartment 112 is desirable to ensure all of the air entering the first compartment 112 from the display chamber 34 goes through the evaporator 116. More specifically, the solid section 128 of the return separator plate 222 is bent upward at an angle from the perforated section 226, so that an edge 230 of the return separator plate 222 engages the underside of the horizontal portion 208. The solid section 228 of the supply separator plate 224 is also bent upward at an angle from the perforated section 226, so that an edge 232 of the supply separator plate 224 engages the underside of the solid section 228 of the return separator plate 222. This configuration acts to seal the edge 230 of the return separation plate 222 against the horizontal portion 110. This seal is aided by the weight of the refrigeration unit applying pressure to a resilient, spring-like configuration of the separation plates 222, 224.

When the refrigeration unit 110 is installed in the refrigeration unit chamber 38, the base 164 is attached to the intermediate support shelf 22 with bolts which are threadably received by the nuts 106 molded into the intermediate support shelf 22. The partition 156 engages the boss 144 and compressible insulating material 150 to form a tight seal around the first compartment 112. The bottom of the divider wall 184 of the partition 156 rests on the compressible insulator material disposed on the intermediate support shelf 22 adjacent the boss and extending laterally across the shelf. The perimeter of the first compartment 112 side of the divider wall, engages the compressible insulating material 150 disposed on the buttress surface 148 of the boss 144. The front edge of the top wall 152 engages the compressible insulating material 150 disposed on the front wall 16 above the sill surface 146. A rib 238 is provided adjacent the perimeter of the underside of the top wall 152 portion of the partition 156. The rib 238 and the perimeter of the underside of the top wall portion engage the compressible insulator 150 disposed on the sill surface 146 of the boss 144, thereby forming a tight seal. Screws 240 are preferably used to further secure the partition 156 to the boss 144 and to increase the downward sealing pressure of the partition 156 against the sill 146 and the cover plate 204 against the separating plate 222.

The second compartment 114, in conjunction with a top cover 242, provides a second airflow pathway. The top cover 242 is preferably an uninsulated sheet of plastic which provides a top for the freezer 10 to improve the freezer's appearance and to limit access to the refrigeration unit 110. The top cover 242 has an air entry opening 244 and a discharge opening 246. The discharge opening 246 is preferably a plurality of louvered slits disposed above the compressor 128. The second airflow pathway is as follows: ambient air from the atmosphere surrounding the freezer 10 is drawn into the second compartment 114 through the air entry opening 244 and into a space disposed between an air entry side 248 of the condenser 122 and the side wall 14; the air is then drawn through the condenser 122 by the condenser fan 124 mounted on a discharge side 250 of the condenser 122; the air is then discharged from the freezer 10 through the discharge opening 246. The air also assists in cooling the compressor 128 by circulating around the compressor 128 before being discharged from the freezer 10. The top cover 242 also defines a hole 252 adjacent the thermostat 172 so that adjustment of the thermostat 172 may be made with out removing the top cover 242 from the freezer 10. The top cover 242 defines another opening 254 to allow a plug for an external lamp and sign assembly 256 to connect to the outlet 190. A wire 258 connecting the plug to the external lamp 256 is preferably press fit into and retained by a channel 260 formed in the top cover 242. The external lamp 256 is attached to the freezer 10 by hanging the lamp 256 on clips 261 that are secured to the cabinet 12.

The freezer 10 also provides a rear cover 262 secured to the cabinet 12 with angle brackets 264. The rear cover 262 is preferably an uninsulated sheet of plastic and provides a backing to the second compartment 114, thereby improving the freezer's appearance and limiting access to the refrigeration unit 110. Clips may also be provided on the rear cover 262 so that the external lamp and sign assembly 256 may alternatively be attached to the rear of the freezer 10.

As indicated, certain components extend through the partition 156, including the condensate drain pipe 212, the electrical wires to the evaporator fan motor 120, condensate lines 176 and the temperature probe 174. Holes are provided in the partition 156 to facilitate the passages of these components. To minimize air and heat transfer between the first compartment 112 and the second compartment 114 through the holes, the holes are preferably sealed with silicone caulk.

Although particular embodiments of the invention have been described in detail, it is understood that the invention is not limited correspondingly in scope, but includes all changes and modifications coming within the spirit and terms of the claims appended hereto.

What is claimed is:

1. A refrigeration machine, comprising:

a cabinet having a front wall, opposing side walls and an intermediate support shelf, a top portion of the front and side walls extend above the intermediate support shelf, the top portion of the front wall having a thickened area and a forward portion of the side walls having a thickened area contiguous with the thickened area of the front wall, the thickened area forming a boss; and a refrigeration unit having an evaporator, a condenser, and an insulated divider wall, wherein said divider wall engages the boss and cooperates with the boss to define a refrigeration unit compartment in which the evaporator is disposed.

2. The refrigeration machine according to claim 1, wherein the cabinet is a unitary piece of rotationally molded plastic.

3. The refrigeration machine according to claim 1, wherein a lower portion of the front wall and a lower portion the side walls extend below the intermediate support shelf, and the lower portions of the front wall and side walls, the intermediate support shelf, a bottom wall and a rear wall define a display chamber.

4. The refrigeration machine according to claim 3, wherein the lower portion of the front wall and the rear wall each define an aperture, the apertures providing access to the display chamber.

5. The refrigeration machine according to claim 4, wherein the front and rear walls each define a channel disposed around the periphery of the apertures.

6. The refrigeration machine according to claim 5, wherein a gasket holder is secured in at least one of the channels, the gasket holder being adapted to receive and retain a gasket.

7. The refrigeration machine according to claim 1, further comprising a bottom wall, the bottom wall having a sealing member disposed adjacent a perimeter of the bottom wall, the sealing member being adapted to minimize foreign objects from going under the refrigeration machine.

8. The refrigeration machine according to claim 7, wherein the sealing member has an inverted "U" shaped cross section.

9. The refrigeration machine according to claim 8, wherein the bottom wall has leveling legs, the leveling legs being adapted to hold the sealing member to the bottom wall.

10. The refrigeration machine according to claim 1, wherein the refrigeration unit compartment is subdivided by the divider wall into a first compartment and a second compartment, the first compartment being defined by the front wall, the forward portion of the side walls, the intermediate support shelf and the divider wall, the second compartment being defined by a rearward portion of the side walls, the intermediate support shelf and the divider wall.

11. The refrigeration machine according to claim 10, further comprising a display chamber disposed beneath the refrigeration unit chamber, the intermediate support shelf defining a return opening and a supply opening through which air flows between the first compartment and the display chamber.

12. The refrigeration machine according to claim 11, further comprising:

a first separation plate and a second separation plate, each separation plate having a solid section;

an evaporator mounted to the partition and disposed in the first compartment; and a cover plate carried by the refrigeration unit and disposed between the evaporator and the return and supply openings, the first separation plate engaging the cover plate to laterally separate the first compartment between the return and supply openings, the second separation plate engaging the first separation plate.

13. The refrigeration machine according to claim 12, wherein each separation plate has a perforated section, the perforated sections of the separation plates respectively covering the return and supply openings.

14. The refrigeration machine according to claim 1, wherein the boss has a buttress surface and a sill surface, and the divider wall engages the buttress surface and an insulated leg joined to an end of the divider wall engages the sill surface.

15. The refrigeration machine according to claim 14, wherein a compressible material is disposed between the buttress surface and the divider wall and the sill surface and the leg.

16. A refrigeration unit, comprising:

an insulated divider wall, the divider wall having a first side and a second side;

an evaporator mounted to the first side of the divider wall;

a base secured to the second side of the divider wall;

a compressor mount and a condenser mount each secured to the base, the compressor mount supporting and elevating a compressor to define a passageway under the compressor, and the condenser mount supporting and elevating a condenser to define a passageway under the condenser; and an electrical tray for holding electrical components slidably disposed in one of the passageways and a condensate collection tray slidably disposed in the other of the passageways.

17. The refrigeration unit according to claim 16, wherein the evaporator has a plurality of generally parallel rows of tubes including a first row of tubes and a last row of tubes, and a plurality of generally parallel fins disposed in a direction transverse to the rows of tubes, adjacent fins having different lengths measured in a direction of air flowing through the evaporator so that each fin intersects a different number of tube rows than the adjacent fins, the last row of tubes intersected by all of the fins and the first row of tubes intersected by none of the fins.

18. The refrigeration unit according to claim 16, further comprising:

a cover plate disposed under the evaporator, and a pipe extending through the divider wall for carrying condensate from the cover plate to the condensate collection tray.

19. The refrigeration unit according to claim 16, wherein the refrigeration unit is adapted to be installed in a cabinet, the cabinet having a refrigeration unit compartment defined by a front wall, opposing side walls, and a shelf, the front wall and the side walls cooperating to form a boss, the boss having a buttress surface and a sill surface, and the divider wall engaging the buttress surface and an insulated leg joined to an end of the divider wall engages the sill surface.

20. The refrigeration unit according to claim 19, wherein a compressible material is disposed between the buttress surface and the divider wall and the sill surface and the leg.

21. A refrigeration machine, comprising:

a cabinet having opposing side walls, the side walls having a plurality of shelf supports, each support having a support surface and an abutment surface; and a shelf having supported surfaces and stop surfaces for respectively engaging the support surface and abutment surface so that the shelf may be positioned on the shelf supports at varying degrees of inclination.

22. A refrigeration machine according to claim 21, wherein the shelf supports are elongated shoulders.

23. A refrigeration machine according to claim 21, wherein the supported surfaces are defined by lateral projection located on opposite sides of the shelf and adjacent opposite ends of the shelf, and the stop surfaces are defined by downward projections located adjacent the lateral projections.

* * * * *